United States Patent [19]

Mayer

[11] 4,013,243

[45] Mar. 22, 1977

[54] MAGAZINE APPARATUS FOR RUN OFF SPOOLS

[76] Inventor: Ingo Mayer, Petersweg 8, Obertshausen, Germany, 6053

[22] Filed: Oct. 17, 1975

[21] Appl. No.: 623,276

[30] Foreign Application Priority Data

Oct. 18, 1974 Germany ..... 348826

[52] U.S. Cl. ..... 242/130; 242/130.2

[51] Int. Cl.[2] ..... B65H 49/02; D03J 5/08

[58] Field of Search ..... 242/129.7, 129.71, 129.72, 242/130, 130.2, 106, 18 R, 20

[56] References Cited

UNITED STATES PATENTS

| | | | |
|---|---|---|---|
| 3,048,349 | 8/1962 | Pitts et al. | 242/130 |
| 3,321,152 | 5/1967 | Poore et al. | 242/130 |

FOREIGN PATENTS OR APPLICATIONS

| | | | |
|---|---|---|---|
| 2,118,443 | 10/1972 | Germany | 242/130 |

*Primary Examiner*—Leonard D. Christian
*Attorney, Agent, or Firm*—Behr & Woodbridge

[57] ABSTRACT

A magazine apparatus adapted for presenting run off spools to a rewinding machine comprising a drive mechanism, a rotating means driven by said drive mechanism, a plurality of free hanging arm means pivotally connected to a said rotating means and a spool support plate connected to said free hanging arm means for supporting the spools during presentation to the machine. According to a preferred embodiment, the rotating means comprises a single bar but also disclosed are embodiments in which the rotating means comprises a three pointed star or a disc means. The rotating means is driven in a plane that is parallel with respect to the pull of gravity. The free hanging arm means and the associated spool support plates are adapted to maintain the spool in an upright position during the entire course of rotation of the rotating means. The disclosed apparatus is relatively simple in structure and allows a machine attendant to swiftly and easily replace exhausted spools.

5 Claims, 3 Drawing Figures

MAGAZINE APPARATUS FOR RUN OFF SPOOLS

BACKGROUND OF THE INVENTION

1. Field Of The Invention

The invention relates to an improved magazine apparatus for presenting run off spools to a rewinding machine.

2. Background Of The Invention

Mechanisms for presenting spools to rewinding machines are known to those of ordinary skill in the art. An example of one such known device is disclosed by Pitts et al U.S. Pat. No. 3,048,349. A more relevant mechanism appears to be also disclosed in German Offenlegungsschrift 2,118,443 of Oct. 26, 1972. The German mechanism is driven by an electric motor through chain means that are well known to those of ordinary skill in the art. Accordingly, the drive means will not be discussed at any length within this disclosure since such additional information would be superfluous. The German mechanism is a complicated apparatus in which two or three spools are held at a variety of different angles including upside down while they are rotated into position for presentation to the rewinding machinery. Due to the various different positional attitudes asssumed by the spools, it is frequently difficult for a machine attendant to change said spools. Additionally, because there are a large variety of moving parts associated with the German mechanism, it is believed to be much more difficult to repair and maintain. It was in the context of such problems with the prior art that the present invention arose.

SUMMARY OF THE INVENTION

According to the preferred embodiment, the invention comprises a drive means, a rotating bar means driven by said drive means, a pair of free hanging and pivoting arm means connected to opposite ends of the rotating bar means and a spool support plate connected to the non-pivoting end of the arm means. The rotating means is adapted to revolve in a vertical plane and the arm means are so attached to the rotating bar means that the spool support plates are always maintained in a horizontal fashion. Accordingly, spools carried by the mechanism are always held upright and are accessible to a machine attendant or mechanic for replacement. Additionally, the mechanism is moderately simple in structure so that it requires minimal maintenance and attention.

The drive mechanism associated with the rotating means is of the sort well known to those of ordinary skill in the art. According to alternative embodiments of the present invention, the rotating means may comprise a three pointed star means or a disc means. Accordingly, more than two free hanging arm means may be associated with different embodiments.

DETAILED DESCRIPTION OF THE INVENTION

During the course of this description, like numbers will be used to indicate like elements with reference to the different drawings included herein.

Figure 3:
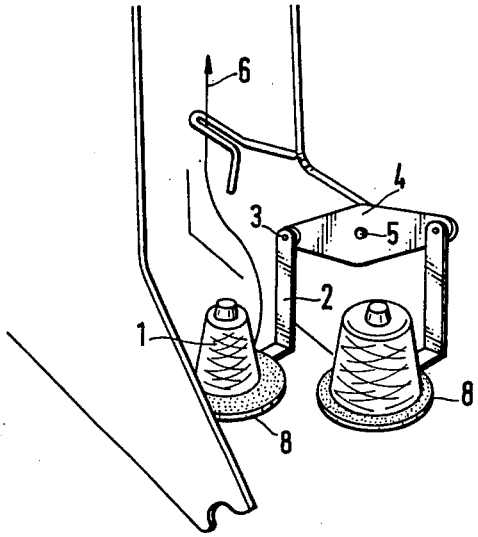
FIG. 3 is a side perspective view of the preferred embodiment of the invention as shown in FIG. 1.
Figure 1:
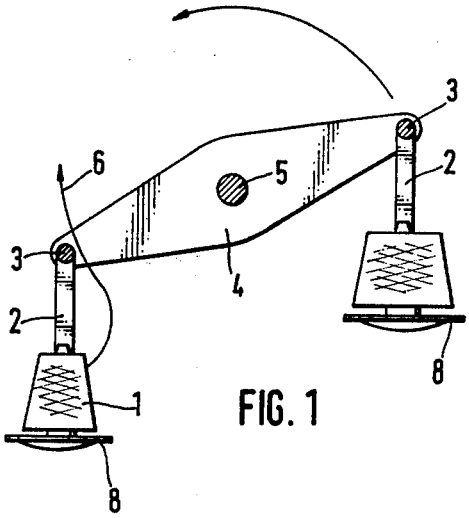
FIG. 1 is a side elevation of the invention according to a preferred embodiment thereof.
Figure 2:
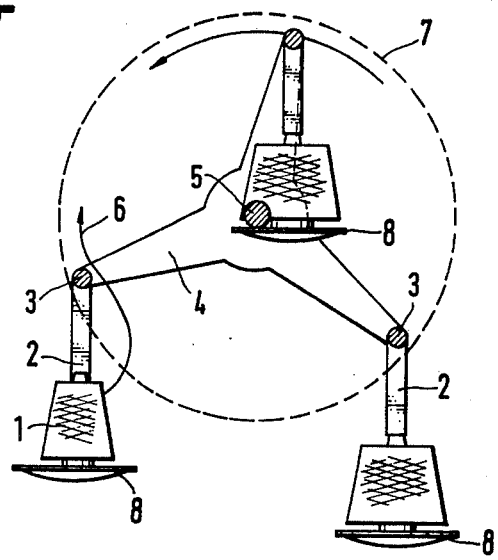
FIG. 2 is a side elevation of the present invention according to an alternative embodiment thereof.

According to FIGS. 1 – 3, the invention is shown to include a rotating means 4 adapted to revolve around a pivot point or shaft 5. The mechanism for driving the rotating means is not shown but is understood to be of the nature of that shown in German Offenlegungsschrift 2,118,443. Such drive means are well known to those of ordinary skill in the rewinding art and for that reason, that feature of the present invention will not be discussed in great detail. The drive mechanism, however, might preferably comprise an electric motor and chain drive which may or may not be controlled by a thread responsive mechanism. The purpose of the drive means is to sequentially present or index the spools 1 with their associated threads 6 to the rewinding machine in a manner that is known.

Associated with each rotating means 4 are at least two arm means 2. One end of each arm means is pivotally connected at point 3 to the rotating means 4. The other end of the arm means 2 is attached to a spool support plate 8. The spool support means 8 is preferably adapted with a spindle or similar device to receive the core of the thread spool 1. A thread 6 is connected to the spool 1 and runs through a guide for feeding into the machine.

The rotating means 4 is adapted to rotate in a plane parallel to the pull of gravity. The arm means and associated spool support plates 8 are pendantly connected to rotating means 4 in such a fashion that the plate 8 is always maintained perpendicular to the pull of gravity during the entire rotation of the rotating means 4. In this manner, the spools 1 are never turned upside down in a fashion often associated with prior art magazines. Additionally, since the spools are always held in a horizontal position, they are much easier to replace.

According to FIG. 1, the preferred embodiment shows the rotating means to comprise a bar having at opposite ends thereof the pivotally connected arm means 2 and the associated spool plate means 8. According to an alternative embodiment of the invention as shown in FIG. 2, the rotating means 4 may comprise a three pointed star having respectively at each point thereof a free hanging arm means 2 and thread spool support plate 8. It would, of course, be clear to one of ordinary skill in the art that a star with more than three points could also be employed.

Yet another embodiment of the present invention is shown in FIG. 2 as dotted line 7. The dotted line 7 describes the periphery of a rotating disc from which the pendant arm means 2 could be supported in a manner similar to that already disclosed. A disc would have the advantage of added strength, however it would, of course, require additional material.

In operation, the apparatus according to the preferred embodiment thereof is loaded with two spools 1 in the manner illustrated in FIGS. 1 and 3. According to FIG. 3, the lower spool 1 is feeding thread 6 into the rewinding machine. After the thread is exhausted, the drive means rotates the rotating bar 4 so as to present the fresh spool to the machine. The control of the drive means may or may not be associated with a device for monitoring the movement of the thread. With the new spool 1 in position, the old exhausted spool becomes accessible in the rear of the machine. A machine attendant can thereafter remove the empty core and replace the exhausted spool with a fresh one. In this manner, the machine can be continually supplied with fresh thread with little or no interruption in the operation of the rewinding mechanism. Since the thread spool never hang in a downward position, there is very little substantial chance of the thread falling off of the magazine. Additionally, the mechanism is very simple in structure and easy to repair and maintain.

It will be appreciated that there are certain modifications that would be within the scope of those of ordinary skill in the art. For instance, while a two ended bar is disclosed as the preferred embodiment of the rotating means, it will be appreciated that a three pointed star or a star with more points and respectively associated arm means may be employed also. Additionally, a drum of disc or other similar mechanism could be used to support the pendulant arms and their associated spools.

While the invention has been particularly shown and described with reference to the preferred embodiment thereof, it will be understood by those skilled in the art that various changes in form and detail may be made therein without departing from the spirit and scope of the invention.

I claim:

1. An improved magazine apparatus for presenting run off spools to a rewinding machine comprising:

a drive means;

a rotating means adapted to rotate in a vertical plane and driven by said drive means;

at least two arm means pivotally connected to said rotating means and adapted to hang freely and downwardly therefrom during rotation of said rotating means; and, at least two spool holding means connected respectively to said arm means for maintaining said run off spools in a plane horizontal to the vertical plane of rotation of said rotating means.

2. The apparatus of claim 1 wherein said rotating means comprises a single bar and wherein said apparatus includes two arm means at opposite ends of said bar.

3. The apparatus of claim 1 wherein said rotating means comprises a disc upon which said arm means are freely supported.

4. The apparatus of claim 1 wherein said rotating means comprises a star shaped means having a free hanging arm means depending from each point of said star means.

5. The apparatus of claim 4 wherein said star means has three distinct points each connected to three individual free hanging arm means respectively.

* * * * *